US007506767B2

(12) United States Patent
Laakso

(10) Patent No.: US 7,506,767 B2
(45) Date of Patent: Mar. 24, 2009

(54) METHOD FOR MANUFACTURING SCREEN CYLINDER AND SCREEN CYLINDER

(75) Inventor: Tauno Laakso, Valkeakoski (FI)

(73) Assignee: Metso Paper, Inc., Helsinki (FI)

( * ) Notice: Subject to any disclaimer, the term of this patent is extended or adjusted under 35 U.S.C. 154(b) by 359 days.

(21) Appl. No.: 10/569,011

(22) PCT Filed: Aug. 18, 2004

(86) PCT No.: PCT/FI2004/000488

§ 371 (c)(1),
(2), (4) Date: Feb. 21, 2006

(87) PCT Pub. No.: WO2005/019529

PCT Pub. Date: Mar. 3, 2005

(65) Prior Publication Data

US 2007/0023331 A1 Feb. 1, 2007

(30) Foreign Application Priority Data

Aug. 22, 2003 (FI) ..... 20031185

(51) Int. Cl.
*B07B 1/49* (2006.01)

(52) U.S. Cl. ..... 209/395; 209/393; 209/400; 209/410; 209/411

(58) Field of Classification Search ..... 209/393, 209/395, 400, 410, 411; 210/485, 497.01, 210/499
See application file for complete search history.

(56) References Cited

U.S. PATENT DOCUMENTS 4,410,424 A * 10/1983 Chupka et al. ..... 209/273
4,416,331 A * 11/1983 Lilly ..... 166/236
4,428,423 A * 1/1984 Koehler et al. ..... 166/231
5,090,721 A 2/1992 Lange
5,094,360 A * 3/1992 Lange ..... 220/485
5,200,072 A * 4/1993 Frejborg et al. ..... 210/232
5,394,600 A 3/1995 Chen
5,647,072 A * 7/1997 Shaffer et al. ..... 4/574.1
5,647,128 A * 7/1997 Aikawa ..... 29/896.62
5,791,495 A 8/1998 Gero et al.
5,804,075 A * 9/1998 Aikawa ..... 210/497.01

(Continued)

FOREIGN PATENT DOCUMENTS

EP 0 357 382 A2 3/1990

(Continued)

*Primary Examiner*—Patrick H Mackey
*Assistant Examiner*—Terrell H Matthews
(74) *Attorney, Agent, or Firm*—Alston & Bird LLP

(57) ABSTRACT

A method is provided for manufacturing a screen cylinder, as well as a screen cylinder with screen wires in the axial direction of the screen cylinder set at predefined intervals into a cylindrical screen surface and fastened to support rods, with end rings are arranged at the ends of the screen cylinder. At least one end ring is mounted at one end of the screen cylinder in such a manner that the end ring is arranged to at least one support rod at the ends of the screen wires or closest to the ends of the screen wires without fastening the end ring to the screen wires. When installing the end ring, a shrink fit is formed between the end ring and support rod, wherein the end ring is arranged to press the support rod substantially perpendicular to the axis of the screen cylinder.

21 Claims, 2 Drawing Sheets

U.S. PATENT DOCUMENTS

| | | | | |
|---|---|---|---|---|
| 6,056,126 | A * | 5/2000 | Schabel et al. | 209/406 |
| 6,491,168 | B1 * | 12/2002 | Lutz et al. | 210/402 |
| 6,579,458 | B2 * | 6/2003 | Mickelat et al. | 210/360.1 |
| 6,915,910 | B2 * | 7/2005 | Lutz et al. | 210/485 |

FOREIGN PATENT DOCUMENTS

| | | | |
|---|---|---|---|
| EP | 0 683 833 | B1 | 5/1997 |
| EP | 0 705 936 | B1 | 1/1998 |
| EP | 0 719 890 | B1 | 12/1999 |
| WO | WO 02/097190 | A1 | 12/2002 |

* cited by examiner

METHOD FOR MANUFACTURING SCREEN CYLINDER AND SCREEN CYLINDER

BACKGROUND OF THE INVENTION

1. Field of the Invention

The invention relates to a method for manufacturing a screen cylinder, in which method screen wires are set at predefined intervals side by side and fastened in the axial direction of the screen cylinder to form a cylindrical screen surface in connection with ring-shaped support rods, and in which method end rings are further mounted at the ends of the screen cylinder.

The invention further relates to a method for manufacturing a screen cylinder, in which method screen wires are set at predefined intervals side by side and fastened to support rods that are bent in the shape of a ring so that the screen wires in the axial direction of the screen cylinder form a cylindrical screen surface, and in which method end rings are further mounted at the ends of the screen cylinder.

The invention yet further relates to a screen cylinder for cleaning or screening fiber pulp, the screen cylinder having screen wires in the axial direction of the screen cylinder set at predefined intervals to form a cylindrical screen surface and fastened to ring-shaped support rods, and the screen cylinder ends having end rings arranged thereto.

2. Description of Related Art

Screen cylinders are used for instance to clean and screen fiber pulp. Screen cylinders are manufactured for instance by fastening parallel screen wires that form a screen surface side by side in a cylindrical form so that a slot of a desired size remains between the wires. Generally this is done by welding or brazing the screen wires to ring-shaped support wires or rods. The screen wires can be fastened to the support rods in the radial direction of the screen cylinder either inside or outside the support rods. To strengthen the structure of the screen cylinder, separate support rings can be fastened to at least a few of the ring-shaped support rods. These support rings are fastened either to the inner circumference or outer circumference of the support rods depending on the relative order of the screen wires and support rods in the radial direction of the screen cylinder. The structure of the screen cylinder is complemented by fastening end rings at the ends of the screen cylinder. When the end rings are fastened to the ends of the screen cylinder, the ends of the screen wires are welded to the end rings.

However, fastening the end rings by welding causes a lot of work, first when opening the root of the weld and, after that, during the actual welding. For instance, in a screen cylinder with a diameter of 1200 mm, over 20 meters of weld joint is produced. Fastening the end rings to the screen cylinder by welding also causes welding stresses in the structure of the screen cylinder, whereby during use loads are generated due to the varying pressure inside the screen and mechanical loads, and the generated loads may make the structure of the screen cylinder break.

BRIEF SUMMARY OF THE INVENTION

It is an object of the present invention to provide a screen cylinder with improved strength and a method for manufacturing it.

The method of the invention is characterized by installing at least one end ring at one end of the screen cylinder in such a manner that the end ring is arranged to at least one support rod at the ends of the screen wires or closest to the ends of the screen wires, and by forming a shrink fit between the end ring and support rod, in which a substantially perpendicular force to the axis of the screen cylinder acts between the end ring and support rod, and the force, through the support rod, locks the screen surface formed by the screen wires substantially immobile in relation to the end ring.

A further characteristic of the method of the invention, in which the support rods are bent in the shape of a ring only after the screen wires are fastened to the support rods, is that at least one end ring of the screen cylinder is installed to one end of the screen cylinder in such a manner that the end ring is arranged to at least one support rod at the ends of the screen wires or closest to the ends of the screen wires, and by forming a shrink fit between the end ring and support rod, in which a substantially perpendicular force to the axis of the screen cylinder acts between the end ring and support rod, and the force, through the support rod, locks the screen surface formed by the screen wires substantially immobile in relation to the end ring.

Further, the screen cylinder of the invention is characterized in that at least one end ring is installed at one end of the screen cylinder in such a manner that the end ring is arranged to at least one support rod at the ends of the screen wires or closest to the ends of the screen wires without fastening the end ring to the screen wires, and that there is a shrink fit between the end ring and support rod, in which a substantially perpendicular force to the axis of the screen cylinder is arranged to act between the end ring and support rod, and the force, through the support rod, locks the screen surface formed by the screen wires substantially immobile in relation to the end ring.

The essential idea of the invention is that in a screen cylinder intended for cleaning or screening fiber pulp, in which screen wires are set in the axial direction of the screen cylinder at predefined intervals to form a cylindrical screen surface and fastened to support rods and in which end rings are arranged at the ends of the screen cylinder, at least one end ring is installed at one end of the screen cylinder in such a manner that the end ring is arranged to at least one support rod at the ends of the screen wires or closest to the ends of the screen wires, and a shrink fit is formed between the end ring and support rod, in which a substantially perpendicular force to the axis of the screen cylinder is arranged to act between the end ring and support rod, and the force, through the support rod, locks the screen surface formed by the screen wires substantially immobile in relation to the end ring.

The invention provides the advantage that the screen wires are not welded to the end ring, whereby stress from the welding and directed to the weld joint are avoided. The slow and expensive manufacturing stage of welding the screen wires and end ring is then also left out. By fastening the end ring and support rod to each other either by separate locking elements extending in the radial direction of the screen cylinder through the end ring to the support rod and/or one or more weld joints between the end ring and support rod, it is possible to further ensure that the screen surface of the screen cylinder does not rotate relative to the end rings and the entire body of the screen. Owing to the invention, the end rings can be re-used when replacing the screen cylinder.

BRIEF DESCRIPTION OF THE SEVERAL VIEWS OF THE DRAWING(S)

The invention will now be described in greater detail by way of preferred embodiments and with reference to the attached drawings, in which FIG. 1 is a schematic cross-sectional view of a screen cylinder in the axial direction of the screen cylinder;

In the figures, the invention is shown simplified for the sake of clarity. Similar parts are marked with the same reference numbers in the figures.

DETAILED DESCRIPTION OF THE INVENTION

Figure 1:
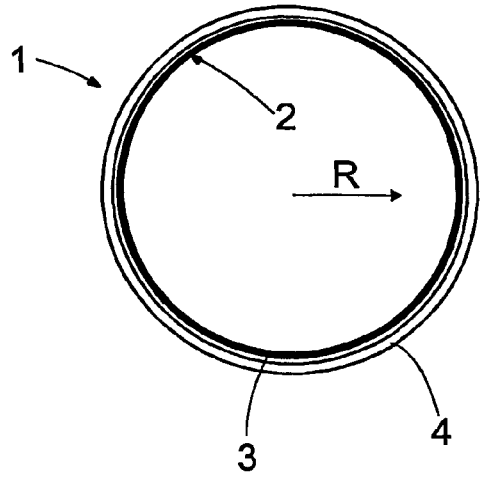
Figure 2:
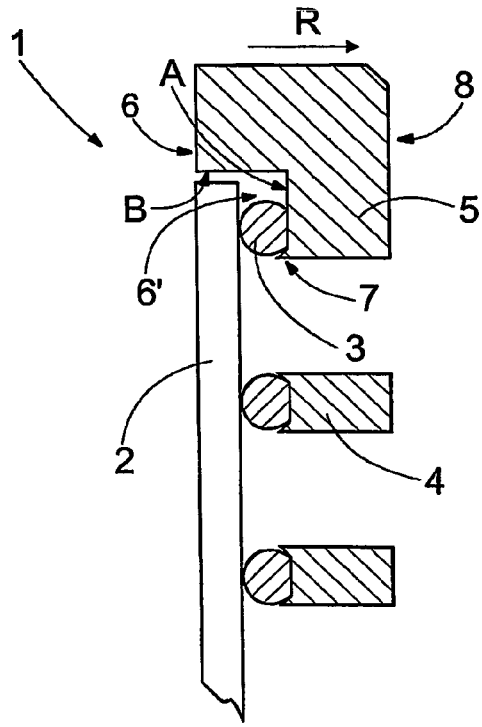
FIG. 2 is a schematic cross-sectional view of the screen cylinder of FIG. 1 as seen from the end of the screen cylinder.

FIG. 1 is a schematic cross-sectional view of a screen cylinder 1 as seen from the end of the screen cylinder 1, and FIG. 2 is a schematic cross-sectional view of the screen cylinder of FIG. 1 in the axial direction of the screen cylinder 1. On the inner surface of the screen cylinder 1, there are screen wires 2 placed around the entire inner circumference of the screen cylinder 1 so that they form a screen surface. Between the screen wires 2, there are screen slots through which liquid and a desired part of the fibers is allowed to flow outside the screen cylinder 1 while slivers and too large fibers, fiber bundles and any other material to be screened remain on the inner surface of the screen cylinder 1 to be removed at its other end. The screen wires 2 are fastened to support wires 3 or rods 3 before the support rods 3 are bent in the shape of a ring in such a manner that a screen cylinder 1 having a suitable diameter is formed. The screen cylinder 1 can also be made in such a manner that the screen wires 2 are fastened to the inner circumference of the support rods 3 that are already in advance bent in the shape of a ring. There are support rods 3 at suitable intervals in the axial direction of the screen cylinder 1 so that the screen wires 2 remain sufficiently rigidly and firmly in place. The screen wires 2 can be fastened to the support rod 3 by welding, but the fastening of the screen wires 2 is also assisted by the pressure due to the bending of the support rod 3 on the inner edge of the support rod 3. Instead of welding, the screen wires 2 can also be fastened to the support rod 3 by a crimp joint. Support rings 4 can also be installed around the support rods 3 to support the support rods 3 and receive the forces generated by the pressure difference caused by varying pressures on different sides of the screen surface of the screen cylinder 1 and, thus, to strengthen the structure of the screen cylinder 1. FIG. 1 also shows arrow R in the radial direction of the screen cylinder 1 and pointing from the direction of the axis of the screen cylinder 1 to the direction of the outer circumference of the screen cylinder. Arrow R is also shown in FIGS. 2 to 6 to facilitate the reading of the figures.

FIG. 2 further shows schematically the fastening of the end rings 5 of the screen cylinder 1 to the screen cylinder 1. The end ring 5 is fastened to the screen cylinder 1 by a shrink fit, in which the end ring 5 is installed around the support rod 3 at the end of the screen cylinder 1 or closest to the end of the screen cylinder 1 and surrounding the screen wires 2, after which a shrink fit is formed between the end ring 5 and support rod 3 so that the end ring 5 presses the support rod 3 substantially perpendicularly to the axis of the screen cylinder 1, i.e. in the radial direction of the screen cylinder 1 toward the inside of the screen cylinder 1.

The end ring 5 can be installed on the end of the screen cylinder 1 for instance in such a manner that it is heated during the installation so that the structure of the end ring 5 expands due to the heat. When the structure of the end ring 5 is suitably expanded, the end ring 5 is installed around the end of the screen cylinder 1 in such a manner that the ends of the screen wires 2 and the support rod 3 at or close to the ends of the screen wires 2 remain inside the inner circumference 6 of the end ring 5 or a part 6' thereof. The outer circumference of the end ring 5 is marked with reference number 8. After this, the end ring 5 is allowed to cool or it is cooled, and as the end ring 5 cools, its structure is normalized and causes pressure between the support rod 3 and end ring 5, i.e. a shrink fit is created between the support rod 3 and end ring 5, in which the active force is directed from the direction of the end ring 5 to the direction of the support rod 3.

The shrink fit between the support rod 3 and end ring 5 is also achieved by tightening a tightening rod around the screen cylinder close to the end of the screen cylinder 1 in such a manner that the screen cylinder 1 is pressed together in the radial direction. After this, the end ring 5 is arranged around the end of the screen cylinder 1 in such a manner that the ends of the screen wires 2 and the support rod 3 at or close to the ends of the screen wires 2 remain inside the inner circumference 6 of the end ring 5 or a part 6' thereof. The tightening rod around the screen cylinder 1 is then removed and the structure of the screen cylinder 1 returns to its original form and, at the same time, pressure is generated between the end ring 5 and support rod 3, in which the active force is directed from the direction of the support rod 3 to the direction of the end ring 5.

The shrink fit between the end ring 5 and support rod 3 is thus generally achieved either by expanding the structure of the end ring 5 before it is installed around the support rod 3, or by pressing the structure of the screen cylinder 1 together using a force acting in the radial direction of the screen cylinder 1 before the end ring 5 is installed around the support rod 3, or by using both of these method together.

FIG. 2 shows schematically a possible cross-section of the end ring 5 when using a shrink fit. The shape of the outline formed by the outer dimensions of the cross-section of the end ring 5 of FIG. 2 essentially resembles a square or rectangle, the inner circumference of which lacks material at the section that will be located around the screen wires 2 and support rod 3 so that the cross-sectional shape of the end ring 5 resembles the letter L. The part 6' of the inner circumference of the end ring 5 is then formed by a surface A in the axial direction of the screen cylinder 1, which settles against the support rod 3 in the shrink fit described above. At right-angles to the surface A in the axial direction of the screen cylinder 1 and forming the part 6' of the inner circumference of the end ring 5, there is a surface B, which is thus a surface perpendicular to the axis of the screen cylinder 1. The length of the surface A in the axial direction of the screen cylinder 1 is dimensioned in such a manner that the screen wires 2 and support rod 3 surrounding the screen wires 2 at the ends of the screen wires 2 or close thereto remain within the length of the surface A in the axial direction of the screen cylinder 1. The length of the surface B perpendicular to the axis of the screen cylinder 1 is designed in such a manner for instance that the screen wires 2 and the support rod 3 surrounding the screen wires 2 remain within the length of the surface B perpendicular to the axis of the screen cylinder 1. On the surface A in the end ring 5, a small edge 7 or notch 7 can be left to support the shrink fit in the axial direction of the screen cylinder 1 so that the end ring 5 will not slide away from the support rod 3 in the axial direction of the screen cylinder 1. Action corresponding to the mechanic locking action of the notch 7 is provided or the locking action can also be increased by making a groove on the surface A of the inner circumference part 6' of the end ring 5, the shape of the groove matching the shape of the support rod 3 and into which groove the support rod 3 is partially inserted.

Thus, a weld joint between the end ring 5 and the screen wires 2 is no longer used in fastening the end ring 5, because it may cause welding stress in the structure of the screen cylinder 1 and, consequently, stress generated during the use of the screen may make the weld joint break. Due to the abandoning of the weld joint, the work phases related to welding, i.e. opening the weld root and the actual welding, are also left out. When using a shrink fit, the end rings 5 can, if desired, be re-used when the screen cylinders 1 are replaced, because, due to the missing weld joints, the end ring 5 is detachable from the screen cylinder 1 in its original condition with relatively little work. This re-usability of the end rings 5 thus saves material and costs when the screen cylinders 1 are replaced.

Figure 3:
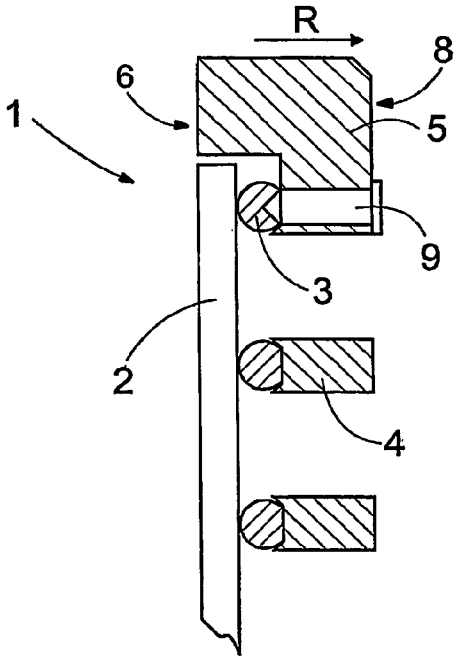
FIG. 3 is a schematic cross-sectional view of a second screen cylinder in the axial direction of the screen cylinder.
Figure 4:
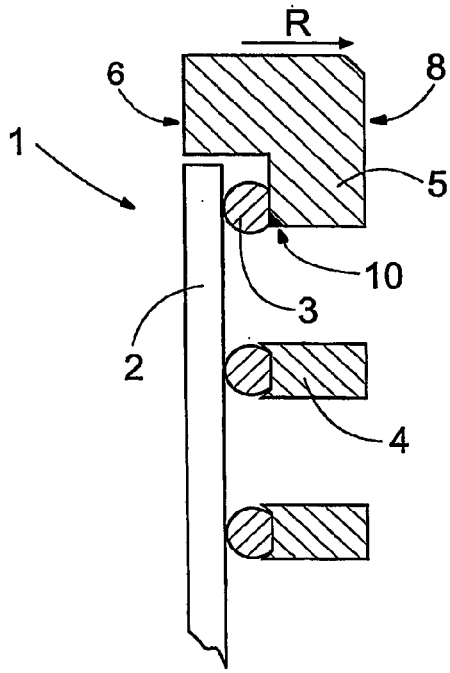
FIG. 4 is a schematic cross-sectional view of a third screen cylinder in the axial direction of the screen cylinder.

The force acting in the shrink fit between the end ring 5 and the support rod 3 at the end of the screen cylinder 1 is so strong that it prevents the rotation of the screen cylinder 1 relative to the end ring 5 and the entire body of the screen when the screen is used. This prevention of rotation can be ensured even further by fastening the end ring S with locking elements, such as locking screws 9, to the support rod 3, as shown in FIG. 3, or by welding the end ring 5 with partial welds 10 to the support rod 3, as shown in FIG. 4. When using locking screws 9, a hole extending from the outer circumference of the end ring 5 to the support rod 3 is drilled and a locking screw 9 is tightened to the hole to mechanically lock the end ring 5 to the support rod 3 and, thus, to the entire screen cylinder 1. Using locking screws 9 also makes it possible to easily re-use the end rings 5. In order to prevent the rotation of the screen cylinder 1, the end rings 5 can, instead of the locking screws 9 or even in addition to them, be fastened with partial welds 10 to the support rod 3, whereby short weld joints are formed between the end ring 5 and support rod 3, preferably at several points along the length of the joint between the end ring 5 and support rod 3.

Figure 5:
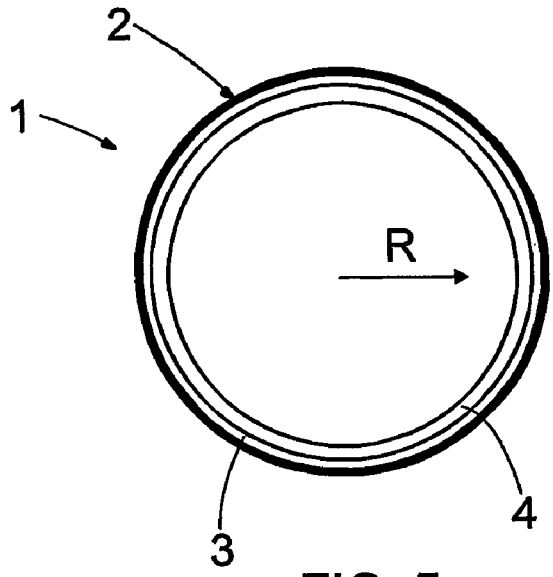
FIG. 5 is a schematic cross-sectional view of a fourth screen cylinder as seen from the end of the screen cylinder.
Figure 6:
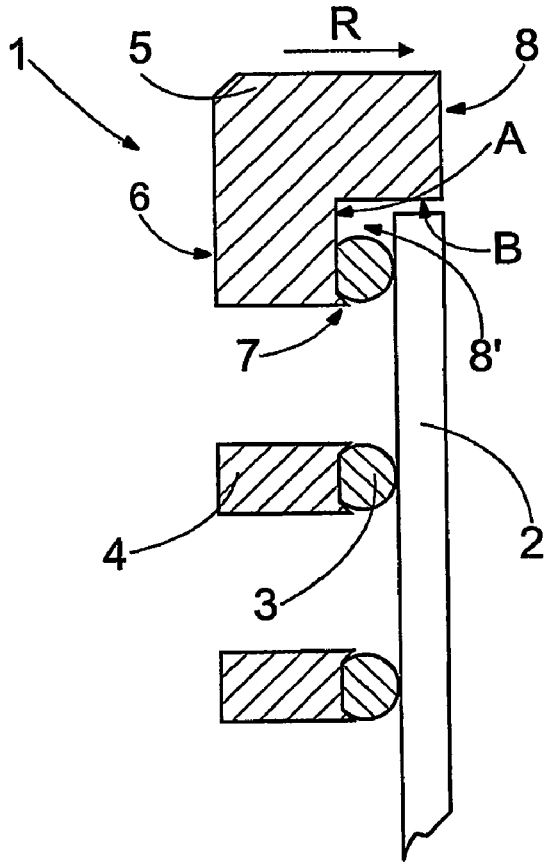
FIG. 6 is a schematic cross-sectional view of the screen cylinder of FIG. 5 in the axial direction of the screen cylinder.

FIGS. 1 to 4 show a screen cylinder 1, in which the screen wires 2 are inside the support rods 3. FIGS. 5 and 6, in turn, show a screen cylinder 1, in which the screen wires 2 are outside the support rods 3. Such a screen cylinder 1 is manufactured either by fastening the screen wires 2 to the support rods 3 bent in advance into the shape of a ring or by fastening the screen wires 2 first to the support rods 3, after which the support rods 3 are bent in the shape of a ring so that a screen cylinder 1 with a suitable diameter is formed, in which the screen surface formed by the screen wires 2 remains outside the support rods 3. In FIG. 6, arrow R is arranged to point into the direction of the outer surface of the screen cylinder 1.

FIG. 6 is a schematic representation of fastening the end ring 5 to the screen cylinder 1. In this case, too, the end ring 5 can be fastened to the screen cylinder 1 with a shrink fit. In this case, the end ring 5 is, however, mounted inside the support rod 3 at the end of the screen cylinder 1 or closest to the end of the screen cylinder 1 and inside the screen wires 2, after which, a shrink fit is formed between the end ring 5 and support rod 3.

In the embodiment of FIG. 6, the end ring 5 can be mounted at the end of the screen cylinder 1 for instance by heating the screen cylinder 1 to expand its structure by the heat in the radial direction of the screen cylinder 1. When the structure of the screen cylinder is suitably expanded, the end ring 5 is mounted inside the end of the screen cylinder 1 in such a manner that the ends of the screen wires 2 and the support rod 3 at the ends of the screen wires 2 or close to the ends of the screen wires 2 remain outside the outer circumference 8 of the end rind 5 or the part 8' of the outer circumference 8. After this, the screen cylinder 1 is allowed to cool or it is specifically cooled, whereby when the screen cylinder 1 cools, its structure returns to normal and causes pressure between the support rod 3 on the inner surface of the screen cylinder 1 and the end ring 5, i.e. a shrink fit is formed between the support rod 3 and end ring 5, in which the acting force is directed substantially perpendicular to the screen cylinder 1 axis from the direction of the support rod 3 to the direction of the end ring 5. In the embodiment of FIG. 6, the structure of the screen cylinder 1 is thus expanded in the radial direction of the screen cylinder 1 for the purpose of mounting the end ring 5.

FIG. 6 is a schematic representation of a possible cross-section of the end ring 5 when using a shrink fit, the shape of the cross-section resembling the end ring 5 shown in FIGS. 2 to 4. The shape of the outline formed by the outer dimensions of the cross-section of the end ring 5 shown in FIG. 6 also substantially resembles a square or rectangle, but material is missing from the outer circumference 8 of the end ring at the section surrounding the screen wires 2 and support rod 3 so that the shape of the cross-section of the end ring 5 resembles the letter L. The surface A in the axial direction of the screen cylinder 1 and settling against the support rod 3 then forms the part 8' of the outer circumference 8 of the end ring 5. The surface B, which is the surface perpendicular to the axis of the screen cylinder 1, is at right angles to the surface A in the axial direction of the screen cylinder 1 and forming the part 8' of the circumference 8 of the end ring 5. The dimensioning of the surfaces A and B can be done as in FIGS. 2 to 4.

The embodiment shown by FIG. 6 can also use a notch 7 or a groove made on the surface A to form a mechanical joint between the end ring 5 and support rod 3. Further, the joint between the end ring 5 and support rod 3 can be strengthened by a locking element and/or partial welds as shown in FIGS. 3 and 4.

The drawings and the related description are only intended to illustrate the idea of the invention. The invention may vary in detail within the scope of the claims.

That which is claimed:

1. A method for manufacturing a screen cylinder, comprising:

fastening a plurality of longitudinally-extending screen wires at lateral intervals about a plurality of ring-shaped support rods, each support rod defining an axis extending therethrough and the support rods being arranged in spaced-apart relation such that the axes thereof are coaxially disposed to define a screen cylinder axis, and such that the screen wires cooperate with the support rods to form a cylindrical screen surface of the screen cylinder, the screen surface having opposed ends, and at least one of the support rods being disposed about one of the ends of the screen surface; and mounting an end ring to the at least one of the support rods closest to one of the ends of the screen surface, in a shrink fit therebetween, whereby a force resulting from the shrink fit is directed substantially perpendicularly to the screen cylinder axis, and acting between the end ring and the at least one of the support rods, secures the screen cylinder surface in substantially immobile relation relative to the end ring via the at least one of the support rods.

2. A method as claimed in claim 1, wherein arranging the screen wires further comprises arranging the screen wires inside the ring-shaped support rods to form the cylindrical screen surface inside the ring-shaped support rods, and wherein mounting the end ring further comprises mounting the end ring to the at least one of the support rods such that at least a portion of an inner circumference of the end ring forms the shrink fit with an outer circumference of the at least one of the support rods, and such that the force resulting from the shrink fit is directed substantially perpendicularly to the screen cylinder axis, in at least one of a direction from the at least one of the support rods toward the end ring and a direction from the end ring toward the at least one of the support rods, to secure the screen cylinder surface in substantially immobile relation relative to the end ring via the at least one of the support rods.

3. A method as claimed in claim 2, further comprising forming the shrink fit between the end ring and the at least one of the support rods by:

at least one of radially expanding the end ring and radially contracting the at least one of the support rods;

mounting the end ring to the at least one of the support rods such that at least a portion of the inner circumference of the end ring surrounds the outer circumference of the at least one of the support rods; and at least one of radially contracting the end ring and radially expanding the at least one of the support rods so as to form the shrink fit therebetween.

4. A method as claimed in claim 3, wherein radially expanding the end ring further comprises heating the end ring, and radially contracting the end ring further comprises at least one of cooling the end ring and allowing the end ring to cool.

5. A method as claimed in claim 1, wherein arranging the screen wires further comprises arranging the screen wires outside the ring-shaped support rods to form the cylindrical screen surface outside the ring-shaped support rods, and wherein mounting the end ring further comprises mounting the end ring to the at least one of the support rods such that at least a portion of an outer circumference of the end ring forms the shrink fit with an inner circumference of the at least one of the support rods, and such that the force resulting from the shrink fit is directed substantially perpendicularly to the screen cylinder axis, in a direction from the at least one of the support rods toward the end ring, to secure the screen cylinder surface in substantially immobile relation relative to the end ring via the at least one of the support rods.

6. A method as claimed in claim 5, further comprising forming the shrink fit between the end ring and the at least one of the support rods by:

radially expanding the at least one of the support rods;

mounting the end ring to the at least one of the support rods such that at least a portion of the outer circumference of the end ring is surrounded by the inner circumference of the at least one of the support rods; and radially contracting the at least one of the support rods so as to form the shrink fit between the end ring and the at least one of the support rods.

7. A method as claimed in claim 1, wherein the end ring defines at least one hole extending radially through the end ring toward the at least one of the support rods, and the method further comprises engaging a locking element with the at least one hole such that the locking element secures the end ring and the at least one of the support rods together.

8. A method as claimed in claim 1, further comprising forming a weld joint between at least a portion of the end ring and a corresponding portion of the at least one of the support rods so as to secure the end ring and the at least one of the support rods together.

9. A method for manufacturing a screen cylinder, comprising:

fastening a plurality of longitudinally-extending screen wires at lateral intervals along each of a plurality of elongate support rods;

forming each of the support rods into a ring shape such that each support rod defines an axis extending therethrough, the support rods being arranged in spaced-apart relation such that the axes thereof are coaxially disposed to define a screen cylinder axis, and such that the screen wires cooperate with the support rods to form a cylindrical screen surface of the screen cylinder, the screen surface having opposed ends, and at least one of the support rods being disposed about one of the ends of the screen surface; and mounting an end ring to the at least one of the support rods closest to one of the ends of the screen surface, in a shrink fit therebetween, whereby a force resulting from the shrink fit is directed substantially perpendicularly to the screen cylinder axis, and acting between the end ring and the at least one of the support rods, secures the screen cylinder surface in substantially immobile relation relative to the end ring via the at least one of the supports rods.

10. A method as claimed in claim 9, wherein forming each of the support rods into a ring shape further comprises forming each of the support rods into a ring shape such that the screen wires are disposed inside the ring-shaped support rods to form the cylindrical screen surface inside the ring-shaped support rods, and wherein mounting the end ring further comprises mounting the end ring to the at least one of the support rods such that at least a portion of an inner circumference of the end ring forms the shrink fit with an outer circumference of the at least one of the support rods, and such that the force resulting from the shrink fit is directed substantially perpendicularly to the screen cylinder axis, in at least one of a direction from the at least one of the support rods toward the end ring and a direction from the end ring toward the at least one of the support rods, to secure the screen cylinder surface in substantially immobile relation relative to the end ring via the at least one of the support rods.

11. A method as claimed in claim 10, further comprising forming the shrink fit between the end ring and the at least one of the support rods by:

at least one of radially expanding the end ring and radially contracting the at least one of the support rods;

mounting the end ring to the at least one of the support rods such that at least a portion of the inner circumference of the end ring surrounds the outer circumference of the at least one of the support rods; and at least one of radially contracting the end ring and radially expanding the at least one of the support rods so as to form the shrink fit therebetween.

12. A method as claimed in claim 11, wherein radially expanding the end ring further comprises heating the end ring, and radially contracting the end ring further comprises at least one of cooling the end ring and allowing the end ring to cool.

13. A method as claimed in claim 9, wherein forming each of the support rods into a ring shape further comprises forming each of the support rods into a ring shape such that the screen wires are disposed outside the ring-shaped support rods to form the cylindrical screen surface outside the ring-shaped support rods, and wherein mounting the end ring further comprises mounting the end ring to the at least one of the support rods such that at least a portion of an outer circumference of the end ring forms the shrink fit with an inner circumference of the at least one of the support rods, and such that the force resulting from the shrink fit is directed substantially perpendicularly to the screen cylinder axis, in a direction from the at least one of the support rods toward the end ring, to secure the screen cylinder surface in substantially immobile relation relative to the end ring via the at least one of the support rods.

14. A method as claimed in claim 13, further comprising forming the shrink fit between the end ring and the at least one of the support rods by:

radially expanding the at least one of the support rods;

mounting the end ring to the at least one of the support rods such that at least a portion of the outer circumference of the end ring is surrounded by the inner circumference of the at least one of the support rods; and radially contracting the at least one of the support rods so as to form the shrink fit between the end ring and the at least one of the support rods.

15. A method as claimed in claim 9, wherein the end ring defines at least one hole extending radially through the end ring toward the at least one of the support rods, and the method further comprises engaging a locking element with the at least one hole such that the locking element secures the end ring and the at least one of the support rods together.

16. A method as claimed in claim 9, further comprising forming a weld joint between at least a portion of the end ring and a corresponding portion of the at least one of the support rods so as to secure the end ring and the at least one of the support rods together.

17. A screen cylinder for cleaning or screening fiber pulp, comprising:

a plurality of ring-shaped support rods, each support rod defining an axis extending therethrough and the support rods being arranged in spaced-apart relation such that the axes thereof are coaxially disposed to define a screen cylinder axis;

a plurality of longitudinally-extending screen wires fastened at lateral intervals to the support rods such that the screen wires cooperate with the support rods to form a cylindrical screen surface of the screen cylinder, the screen surface having opposed ends, with at least one of the support rods being disposed about one of the ends of the screen surface; and an end ring configured to be shrink fit mounted to the at least one of the support rods closest to one of the ends of the screen surface, the shrink fit end ring thereby being configured to exert a force directed substantially perpendicularly to the screen cylinder axis, the force acting between the end ring and the at least one of the support rods, to secure the screen cylinder surface in substantially immobile relation relative to the end ring via the at least one of the support rods.

18. A screen cylinder as claimed in claim 17, wherein the screen wires forming the screen surface are arranged inside the ring-shaped support rods to form the cylindrical screen surface inside the ring-shaped support rods, and wherein the end ring is mounted to the at least one of the support rods such that at least a portion of the inner circumference of the end ring forms the shrink fit with an outer circumference of the at least one of the support rods, and such that the force resulting from the shrink fit is directed substantially perpendicularly to the screen cylinder axis, in at least one of a direction from the at least one of the support rods toward the end ring and a direction from the end ring toward the at least one of the support rods, to secure the screen cylinder surface in substantially immobile relation relative to the end ring via the at least one of the support rods.

19. A screen cylinder as claimed in claim 17, wherein the screen wires forming the screen surface are arranged outside the ring-shaped support rods to form the cylindrical screen surface outside the ring-shaped support rods, and wherein the end ring is mounted to the at least one of the support rods such that at least a portion of an outer circumference of the end ring forms the shrink fit with an inner circumference of the at least one of the support rods, and such that the force resulting from the shrink fit is directed substantially perpendicularly to the screen cylinder axis, in a direction from the at least one of the support rods toward the end ring, to secure the screen cylinder surface in substantially immobile relation relative to the end ring via the at least one of the support rods.

20. A screen cylinder as claimed in claim 17, wherein the end ring defines at least one hole extending radially through the end ring toward the at least one of the support rods, and the screen cylinder further comprises a locking element engaged with the at least one hole such that the locking element secures the end ring and the at least one of the support rods together.

21. A screen cylinder as claimed in claim 17, further comprising at least one weld joint formed between at least a portion of the end ring and a corresponding portion of the at least one of the support rods so as to secure the end ring and the at least one of the support rods together.

* * * * *